US008313211B2

(12) United States Patent
Libohova et al.

(10) Patent No.: US 8,313,211 B2
(45) Date of Patent: Nov. 20, 2012

(54) PORTABLE LAMP BANK AND LENS ASSEMBLY FOR USE THEREWITH

(75) Inventors: Agjah Libohova, Westbury, NY (US); Stephen C. Arnold, W. Henrietta, NY (US); Kimball Straw, W. Henrietta, NY (US)

(73) Assignee: Autronic Plastics, Inc., Westbury, NY (US)

( * ) Notice: Subject to any disclaimer, the term of this patent is extended or adjusted under 35 U.S.C. 154(b) by 555 days.

(21) Appl. No.: 12/487,587

(22) Filed: Jun. 18, 2009

(65) Prior Publication Data

US 2010/0019690 A1 Jan. 28, 2010

Related U.S. Application Data

(60) Provisional application No. 61/083,081, filed on Jul. 23, 2008.

(51) Int. Cl.

| | |
|---|---|
| ***F21V 21/00*** | (2006.01) |
| ***F21V 8/00*** | (2006.01) |
| *G05F 1/00* | (2006.01) |
| *H05B 37/02* | (2006.01) |
| *H05B 39/04* | (2006.01) |
| *H05B 41/36* | (2006.01) |
| *H05B 37/00* | (2006.01) |
| *H05B 39/00* | (2006.01) |
| *H05B 41/00* | (2006.01) |

(52) U.S. Cl. ..... 362/217.01; 362/268; 315/294; 315/312

(58) Field of Classification Search ..... None
See application file for complete search history.

(56) References Cited

U.S. PATENT DOCUMENTS

| | | | | |
|---|---|---|---|---|
| 4,369,487 | A * | 1/1983 | Carlow | 362/258 |
| 6,072,708 | A * | 6/2000 | Fischer | 363/84 |
| 7,140,742 | B2 | 11/2006 | Pohlert | |
| 7,229,185 | B1 | 6/2007 | Galvez | |
| 2006/0215422 | A1 | 9/2006 | Laizure | |
| 2007/0195527 | A1 | 8/2007 | Russell | |
| 2008/0212319 | A1 * | 9/2008 | Klipstein | 362/231 |

OTHER PUBLICATIONS

Philips Press Information [online]. Philips, 2007[retrieved on Sep. 8, 2011]. Retrieved from the Internet:<URL: http://www.philipslumileds.com/newsandevents/releases/PR64.pdf>.*

ProTran1. Datasheet.[online]. ProTran1, 2008[retrieved on Sep. 8, 2011]. Retrieved from the Internet:<URL: http://www.imtram.com/pdfs/Imtram%20-%20ProTran1%20Catalogue.pdf>.*

Philips Press Information [online]. Philips, 2007 [retrieved on Sep. 8, 2011]. Retrieved from the Internet<URL:http://www.philipslumileds.com/newsandevents/release/PR64.pdf>.*

* cited by examiner

*Primary Examiner* — Douglas W Owens
*Assistant Examiner* — Dedei K Hammond
(74) *Attorney, Agent, or Firm* — Ostrolenk Faber LLP

(57) ABSTRACT

A portable lamp bank in accordance with an embodiment of the present application includes an elongated housing, a power source mounted in the housing and electrically connected to the external high voltage input voltage to provide a substantially constant driving voltage and a first light engine mounted in the elongated housing and electrically connected to the power source. The light engine includes a plurality of high output light emitting diodes that are driven based on the driving voltage of the power source to provide output light.

24 Claims, 9 Drawing Sheets

PORTABLE LAMP BANK AND LENS ASSEMBLY FOR USE THEREWITH

CROSS-REFERENCE TO RELATED APPLICATION

The present application claims benefit of and priority to U.S. Provisional Patent Application Ser. No. 61/083,081 filed Jul. 23, 2008 and entitled PORTABLE LAMP BANK, the entire content of which is hereby incorporated by reference herein.

BACKGROUND

1. Field of the Disclosure

The present application relates to a portable lamp bank with high efficiency, high reliability and improved durability. The present application also relates to a lens for use in the portable lamp bank.

2. Related Art

A lamp bank 1 such as the one illustrated in FIG. 1, is commonly used in underground rail systems to provide a source of portable light for workers in the tunnels. The lamp 1 typically includes a plurality of sockets for incandescent bulbs and can be connected directly to the electrified rail that is commonly used to power trains in the rail system. This electrified rail, commonly referred to as the third rail, provides a high voltage supply to the trains in the system. As a result, a relatively high voltage is provided to the lamp 1 connected thereto. This conventional lamp 1 typically consumes in excess of 300 W of power. Further, this lamp 1 is subject to frequent failure given the relatively harsh environment of the subway tunnels.

Thus, it would be beneficial to provide a lamp bank for use in such an underground rail tunnel that avoids these problems.

SUMMARY

It is an object of the present disclosure to provide a portable lamp bank with improved efficiency and resiliency.

It is an object of the present disclosure to provide a lens for use with a portable lamp bank with improved efficiency and resiliency.

A portable lamp in accordance with an embodiment of the present application includes an elongated housing, a power source mounted in the housing and electrically connected to the external high voltage input voltage to provide a substantially constant driving voltage and a first light engine mounted in the elongated housing and electrically connected to the power source. The light engine includes a plurality of high output light emitting diodes that are driven based on the driving voltage of the power source to provide output light.

A lens assembly for use in a portable lamp including a plurality of high output light emitting diodes in accordance with an embodiment of the present application includes a plurality of lenslets, wherein a single lenslet is positioned in front of each high output light emitting diode of the plurality of high output light emitting diodes, the single lenslet operable to direct light from the high output light emitting diode in front of which it is positioned in a first direction and an outer lens, positioned in front of the plurality of lenslets and operable to direct light from the lenslets in a desired direction.

A light engine for use in a portable lamp including a power source providing a driving voltage and supplied by an external high voltage input voltage in accordance with an embodiment of the present application includes a plurality of high output light emitting diodes, a printed circuit board operable to electrically connected the power source to the plurality of light emitting diodes and a control circuit operable to control a driving current provided to the plurality of light emitting diodes based in the driving voltage provided by the power source.

Other features and advantages of the present invention will become apparent from the following description of the invention which refers to the accompanying drawings.

DETAILED DESCRIPTION OF THE EMBODIMENTS

Figure 2:
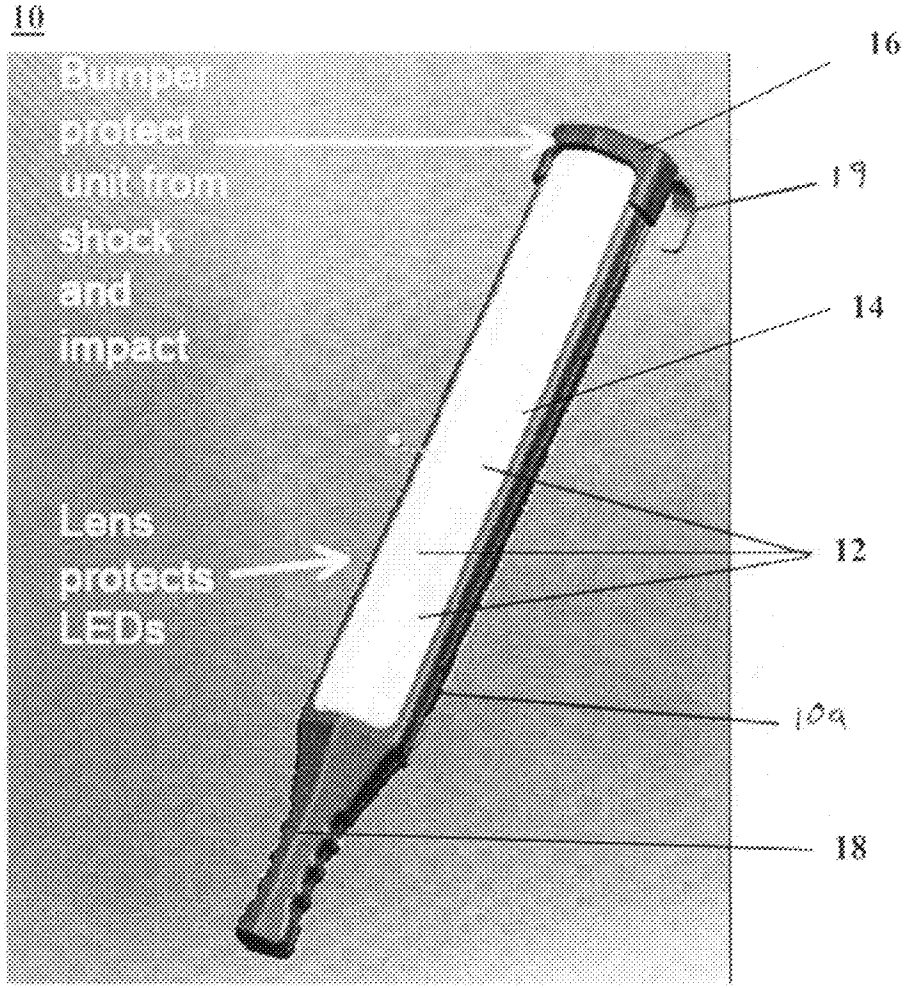
FIG. 2 is an illustration of a portable lamp bank in accordance with an embodiment of the present application.

A portable lamp bank, or portable lamp, 10 in accordance with an embodiment of the present application is illustrated in FIG. 2. The lamp 10 preferably includes a plurality of light emitting diodes (LEDs) 12 which replace the incandescent bulbs used in conventional lamps. In addition, a lens assembly 14 is provided over the LEDs 12 to help protect them from breakage. The lens assembly 14 is preferably translucent and made of a durable material. While the lens assembly 14 protects the LEDs 12 from damage, it also provides improved optical characteristics for the light emitted from the LEDs as is described in further detail below. For example, the lens assembly 14 may be a Fresnel lens and may be used to help diffuse the light provided from the LEDs 12 over a wider area. Alternatively, the lens assembly 14 may be used to focus light, if desired. In addition, the lens assembly 14 may include decorative features, thus providing lens aesthetics. In addition, a bumper 16 is provided on at least one end of the lamp 10 to absorb shock. Thus, the bumper 16 is preferably made of a resilient material and provides cushioning of impact when the lamp is inadvertently dropped, for example. If desired, a resilient bumper 16 may be provided on both ends of the lamp 10. A handle 18 may be provided on an end of the lamp 10 as well. A first bumper 16 is preferably positioned opposite the handle 18 while a second bumper (not shown) may be positioned on the end of the handle 18, if desired. The lamp 10 generally includes an elongated housing 10*a* in which the LEDs 12 are mounted and on which the lens assembly 14 is provided.

Figure 3:
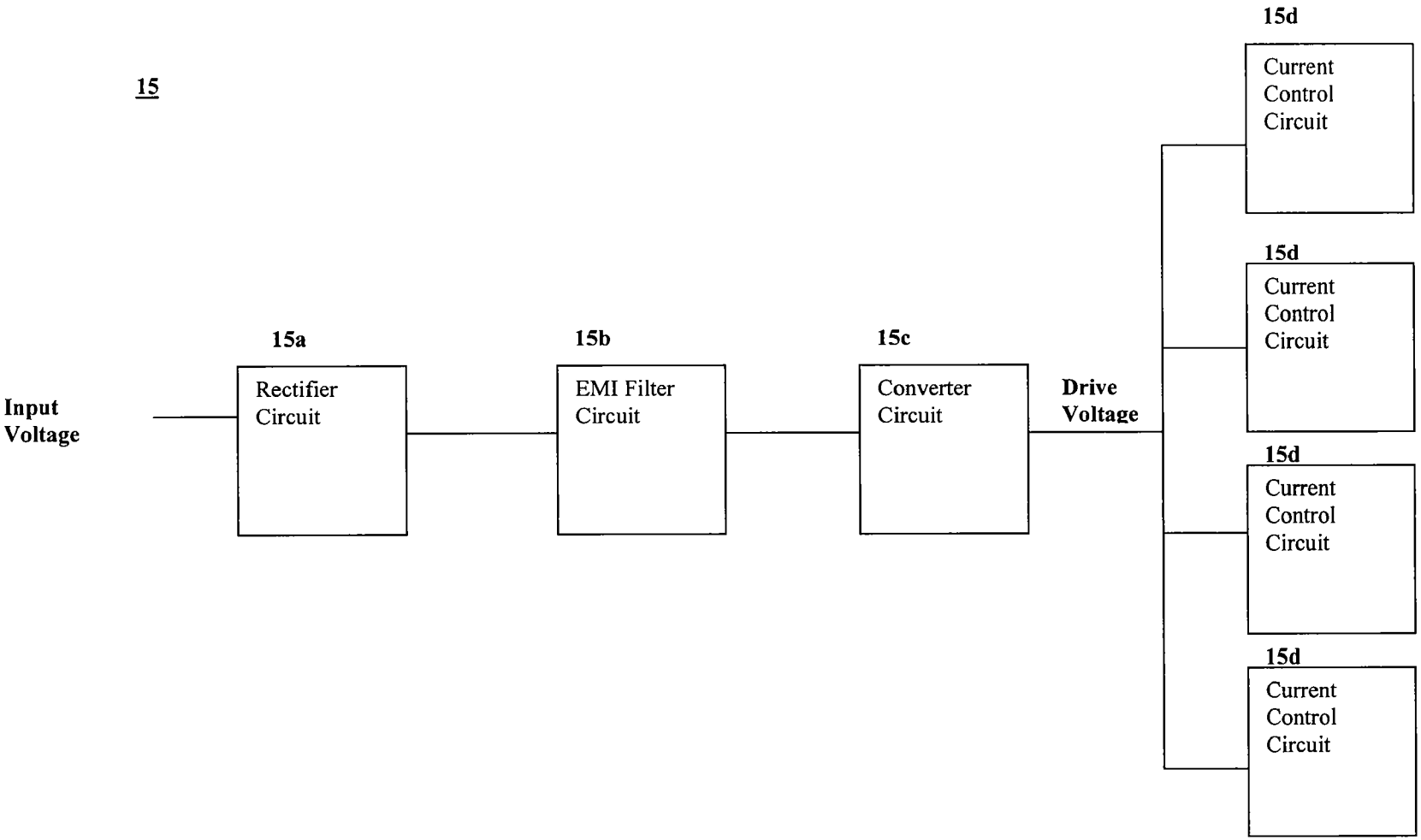
FIG. 3 is an exemplary block diagram of a power source for the portable lamp bank of FIG. 2.

The lamp 10 preferably includes a power source 15 (See FIG. 3) which is used to convert an external high voltage input voltage provided by the third rail, typically a 450-750 V DC voltage, into a lower voltage suitable for powering the LEDs 12. The external high voltage input voltage is preferably a voltage of no less than 277V. FIG. 3 is an exemplary block diagram of such a power source 15 for use in the lamp 10. The power source 15 preferably provides polarity independence and is connected to the third rail via one or more power cables. The power source is preferably flexible enough to accommodate input voltages of between 277-1000 volts. In addition, the power source 15 is also resistant to voltage spikes of up to 3 kV. The power cables can be removably attached to the third rail as desired. Alternatively, a conventional power cord with a plug may be provided and the power source may be operable to accommodate 10 or 220 volt AC supply voltages. In addition, the power source may be structured to accommodate a 480 volt three phase supply voltage as well.

More specifically, the power source 15 preferably includes a rectifier circuit 15*a* connected to the external high voltage input voltage. The use of the rectifier circuit 15*a* allows for the power source 15 to be polarity independent. That is, the polarity of the input voltage will not affect operation of the power source 15. In one embodiment, the rectifier circuit 15*a* is a full bridge rectifier, however, any suitable rectifier circuit may be used. An EMI filter circuit 15*b* is provided to minimize electromagnetic interference (EMI). The filter circuit 15*b* is preferably positioned at an output of the rectifier circuit, but may alternatively be positioned at an input to the rectifier circuit. In this case, the EMI filter 15*b* also provides transient protection. The filter circuit preferably includes capacitive and inductive components commonly used in filters. A converter circuit 15*c* is connected to an output of the filter circuit 15*b* and converts the rectified high voltage input voltage into a lower voltage more suitable for use in driving the LEDs 12 to produce light. In one embodiment, the converter circuit 15*b* is a transformer, however, any suitable voltage converter circuit may be used. The driving voltage provided by the converter circuit 15*c* is used to drive the LEDs 12. This drive voltage is preferably provided in a relatively constant manner.

Figure 4:
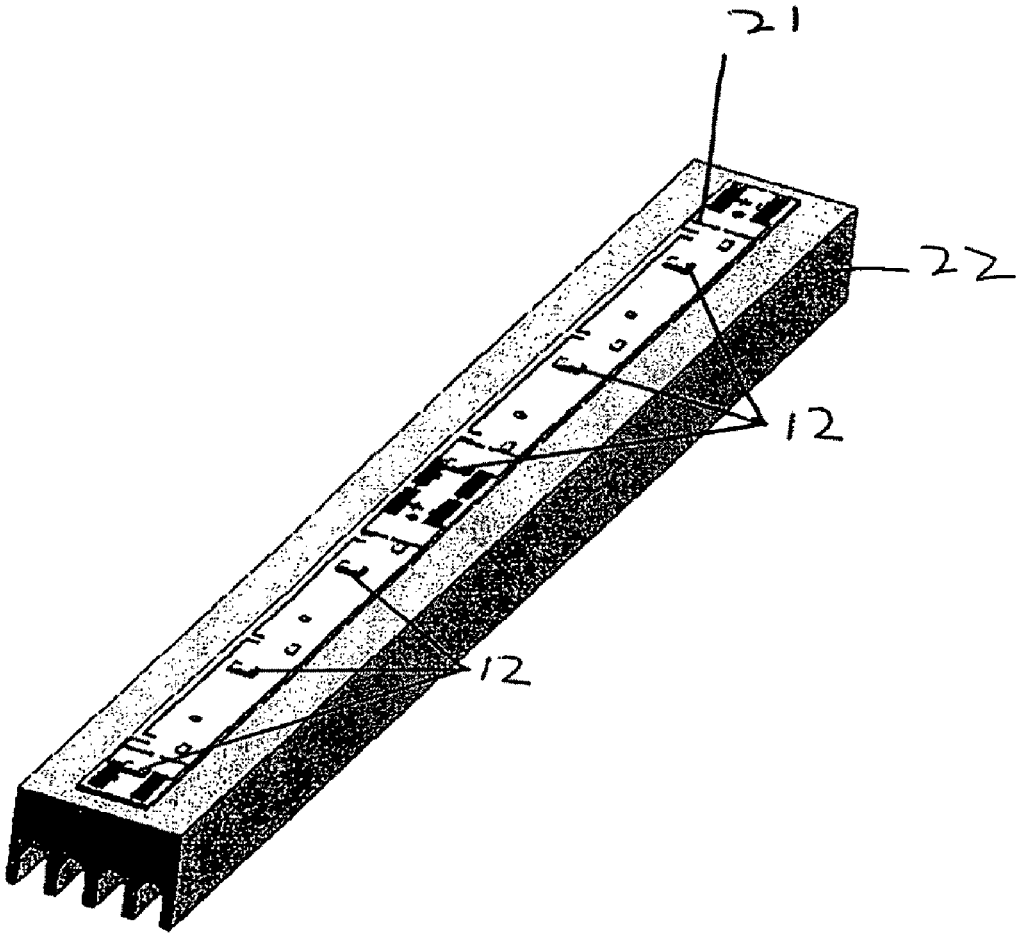
FIG. 4 is an exemplary illustration of a plurality of light emitting diodes mounted on a heat sink of a light engine in the portable lamp bank of FIG. 1.

In the preferred embodiment, the drive voltage output from the filter circuit 15*c* is provided to one of several current control circuits 15*d* which are, in turn, connected to one of the light engines 200 (See FIG. 4, for example) on which the LEDs 12 are mounted. That is, a separate current control circuit 15*d* is provided for each light engine 200 in the lamp 10. The current control circuit 15*d* receives the smooth driving voltage from the filter circuit 15*c* and provides a driving current to the LEDs 12. If additional, or fewer, light engines 200 are included in the lamp 10, additional or fewer current control circuits 15*d* may be used. In a preferred embodiment, the current control circuit 15*d* is integral with the printed circuit board 21 of each light engine 200. Alternatively, they may be incorporated into the power source 15 and the power source may include separate outputs for each light engine 200 to which it is connected.

The power source 15 is preferably provided on a rear side of the lamp 10, opposite the LEDs 12. In a preferred embodiment, there is no on/off switch provided in the lamp 10. In many cases, workers will use the lamp 10 to test whether or not the third rail is electrified. Thus, the lamp 10 will always light if it is connected to an electrified third rail and there is no danger that a false result is provided because a switch is inadvertently turned off. If desired, however, an on/off switch may also be included.

In a preferred embodiment, the LEDs 12 are organized into 4 light engines 200 (See FIG. 4), each of which includes 6 LEDs 12 for a total of 24 LEDs. The light engine allows for a modular construction of the lamp 10. Each light engine 200 preferably includes a printed circuit board (PCB) 21 that is thermally coupled to a heat sink 22. That is, each of the light engines includes a printed circuit board 21 and heat sink 22. The LEDs 12 are mounted on the PCB 21 and each of the light engines 200 is also preferably connected to the power source 15. A heat sink (not shown) is also preferably connected to, or integrated with, the power source 15 as well. In a preferred embodiment, this heat sink is independent of the heat sinks 22 connected to the light engines 200. The heat sinks 22 draw heat away form the LEDs and the power source 15, and thus, efficiency of the lamp 10 is improved. As noted above, the current control circuits 15*d* may be integrated into the PCB 22 of the light engine 200, or may be separate.

Figure 1:
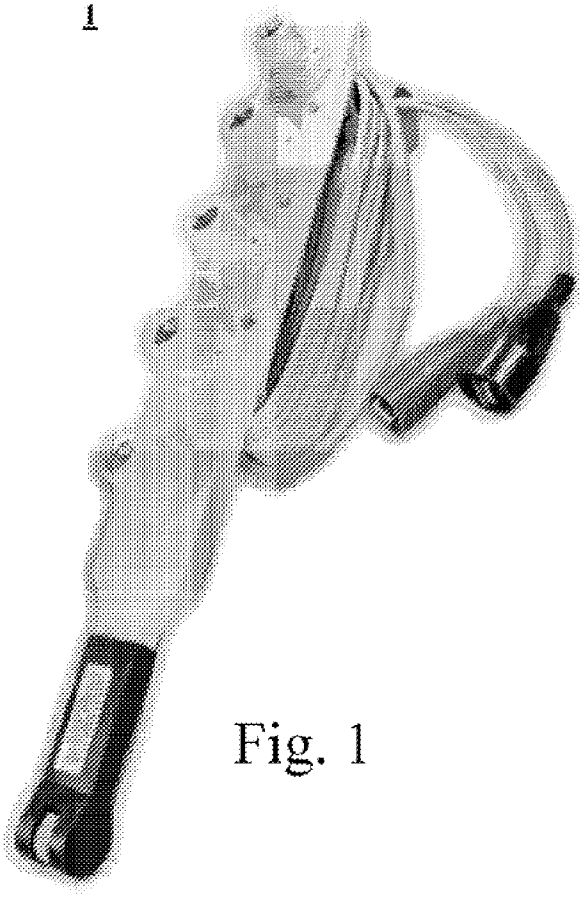
Fig. 1 Prior Art
FIG. 1 is an illustration of a conventional lamp bank.

The lamp 10 consumes approximately 90 W of power, as compared to the over 300 W typically used by conventional lamp 1 illustrated in FIG. 1. Thus, the lamp 10 of the present application provides much higher efficiency when compared with conventional lamps. Further, the lens assembly 14 and bumper 16 provide for increased resiliency and durability of the lamp as well, thus allowing the lamp to last longer. This is particularly useful since the lamp 10 is intended for use in the relatively harsh environment of a subway tunnel. Further, since the lens assembly 14 covers the LEDs 12, the lamp is essentially sealed, thus providing superior performance in a damp environment which is also common in subway tunnels.

Figure 2A:
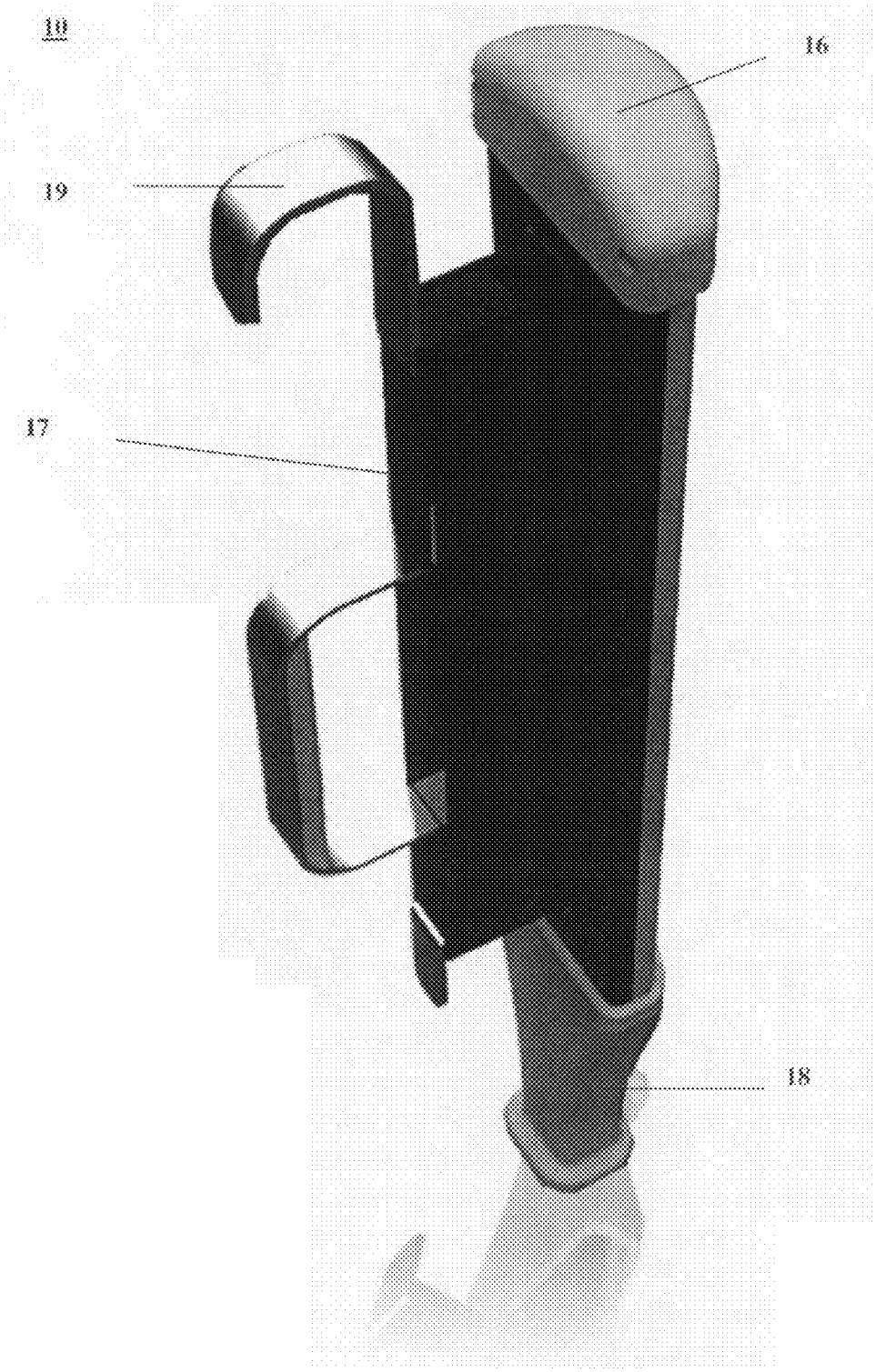
FIG. 2A is an illustration of a rear view of the portable lamps bank of FIG. 2.

The lamp 10 may include a strap or other element to aid in carrying it, if desired. In addition, a hook 19 (See FIG. 2) may be provided on the second end of the housing 10*a*, preferably opposite handle 18, to allow the lamp 10 to be easily hung up while in use. In addition, the rear of the housing 10*a* may include a bracket structure 17 (See FIG. 2A) extending outward therefrom. The bracket structure 17 is convenient to allow the optional power cord to be looped around the bracket for storage. As illustrated, the hook 19 may be incorporated with the bracket structure 17, if desired.

In order to maximize lighting efficiency for the desired environment, it is beneficial to maximize light output provided by the lens assembly 14 noted above. Since the lamp 10 is preferably used in a subway tunnel, the positioning of the lamp 10 and the lighting conditions in the tunnel are preferably considered determining how best to maximize light output from the LEDs 12.

The lamp 10 will commonly be suspended above the tracks, via hook 19, for example, to allow workers to see their work environment. In light of the generally poor lighting conditions in rail tunnels, it is important that the lamp 10 provide sufficient lighting to allow a worker to efficiently work and avoid injury. Typically, the lamp 10 will be suspended above the tracks in the vicinity of the workers. The lamp will preferably provide adequate lighting from a height of 11 feet, or so, and will extend over an area of 2-11 feet from the lamp 10.

Since the lamp 10 will preferably be positioned over the tracks, the lens assembly 14 will preferably be structured to direct light downward toward the tracks. The lamp 10 may be structured to tilt downward itself, preferably approximately 20 degrees, or so, to aid in these lighting requirements.

Figure 5:
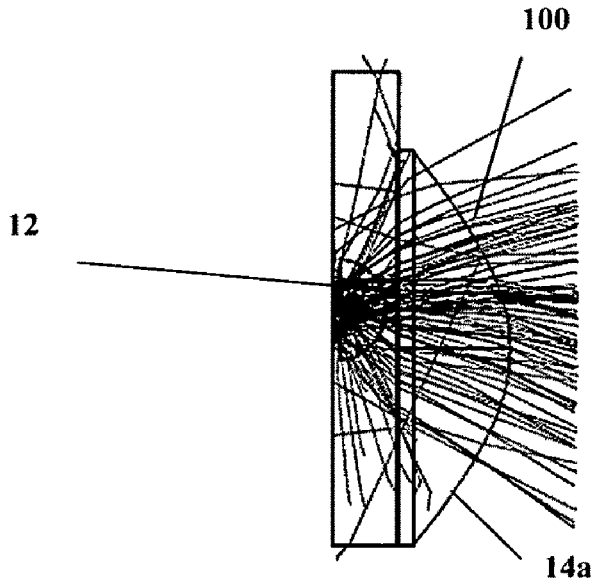
FIG. 5 is an illustration of an exemplary lenslet intended for use with the portable lamp bank of the present application.

The lens assembly 14 is preferably structured to provide for these lighting requirements. In a preferred embodiment, the lens 14 utilizes a two piece construction with a first element, a lenslet 14*a* mounted over the LEDs 12 and an outer lens 14*b* mounted in front of the lenslet 14*a*. FIG. 5 illustrates an exemplary embodiment of the lenslet 14*a* over the LED 12 including a plurality of light rays 100 projecting therefrom to simulate the path of light from the LED through the lenslet 14*a*. As illustrated in FIG. 5, the lenslet 14*a* collects light from the LED 12 and directs substantially all of the light in a first direction. In accordance with one embodiment, the lenslet 14*a* is made of a polycarbonate material and has a thickness of 2.8 mm and a diameter of 10 mm. The left side surface has a planar shape while the right side surface has a convex shape. The convex shape of the right side surface of the lenslet 14*a* acts to reduce the emission angle of light collected from the LED. In a preferred embodiment, the left side surface is positioned 1.7 mm from an LED reference surface. The features of the lenslet 14*a* are further described by the following equation:

$$z = \frac{cr^2}{+\sqrt{1-(1+k)c^2r^2}}$$

z=surface sag c=1/(Vertex Radius)=−1/4.0 mm=−0.25 $mm^{-1}$ k=conic constant=−2.0 r=radial distance from lens axis(in mm)

While the above parameters are preferred, it in noted that variations of these parameters may be made as desired.

Figure 6:
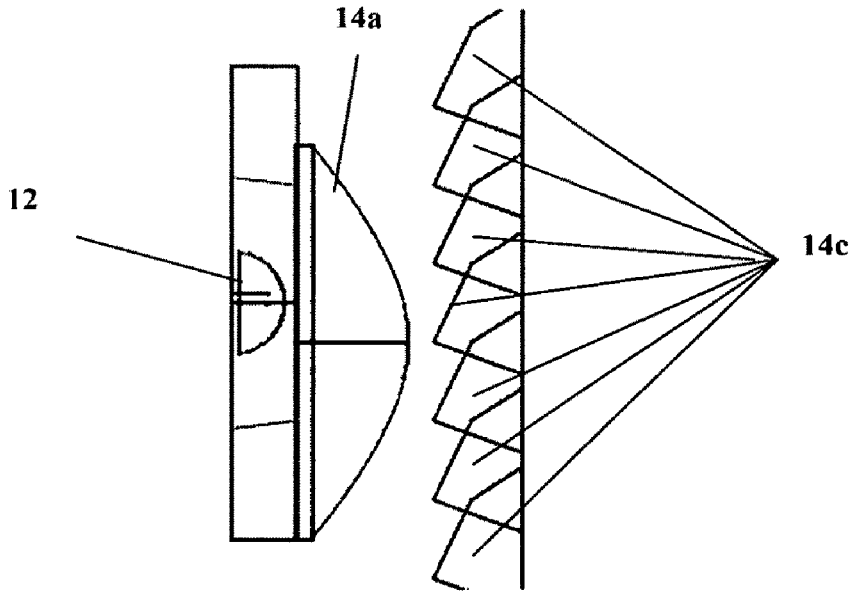
FIG. 6 is an illustration of a lenslet and an outer lens for use with the lenslet of FIG. 5.

FIG. 6 illustrates the lenslet 14*a* and LED 12 with the outer lens 14*b* positioned in front of the lenslet. A plurality of facets 14*c* is formed on the inner surface of the outer lens 14*b*. The facets 14*c* are provided to direct light from the lenslet 14*a* downward through the outer lens 14*b* to provide for the lighting requirements described above. That is, the facets 14*c* help to direct light downward toward the track surface. More specifically, the outer lens is a prismatic lens that deflects and angularly shifts a center of a beam of light provided from the lenslet. In a preferred embodiment, the angle of the facets is approximately 25 degrees and the distance from the back of the lenslet 14*a* and the front of the outer lens 14*b* is approximately 0.28 inches. The angle of the facets 14*c* and the distance the back of the lenslet 14*a* and the front of the outer lens 14*b* may be modified as desired.

Figure 6A:
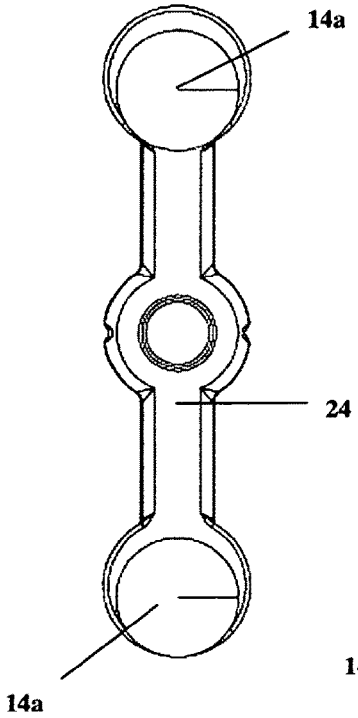
FIG. 6A is a front view of a carrier including the lenslet of FIG. 5.
Figure 6B:
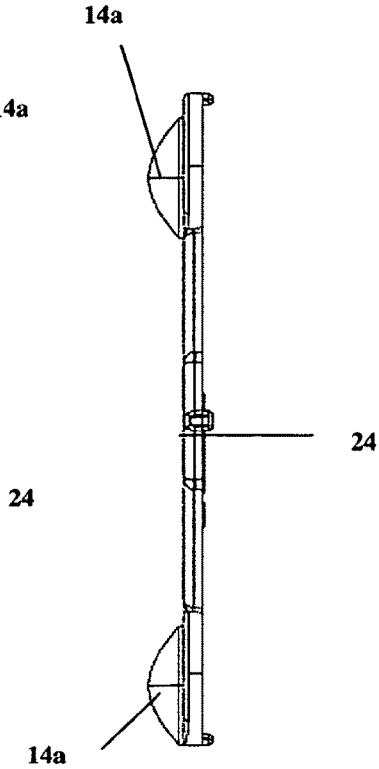
FIG. 6B is a side view of a carrier including the lenslet of FIG. 5.
Figure 6C:
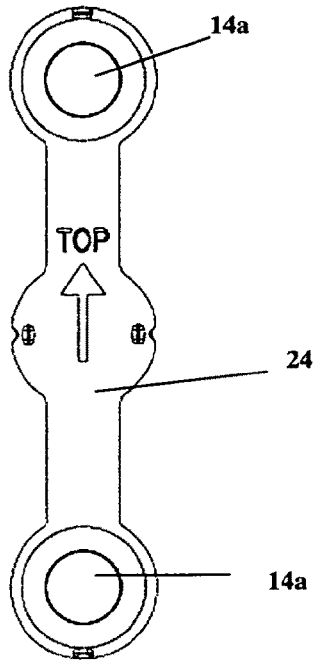
FIG. 6C is a rear view of a carrier including the lenslet of FIG. 5.
Figure 7A:
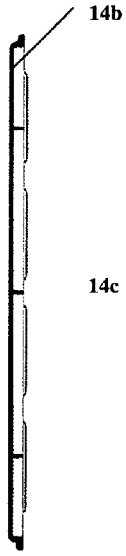
FIG. 7A is a right side view of the outer lens of FIG. 6.
Figure 7B:
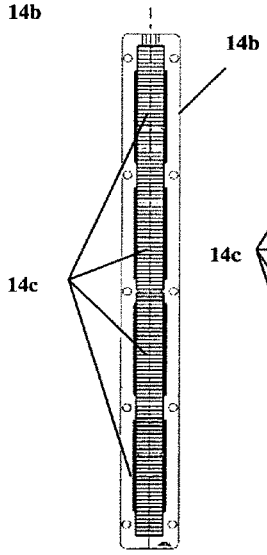
FIG. 7B is a rear view of the outer lens of FIG. 6.
Figure 7C:
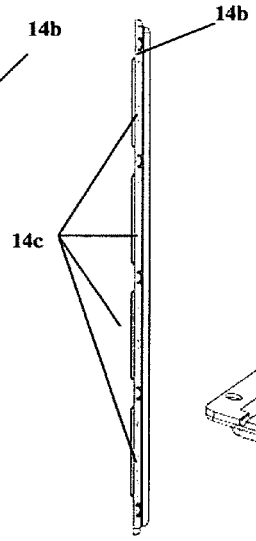
FIG. 7C is a left side view of the outer lens of FIG. 6.
Figure 7D:
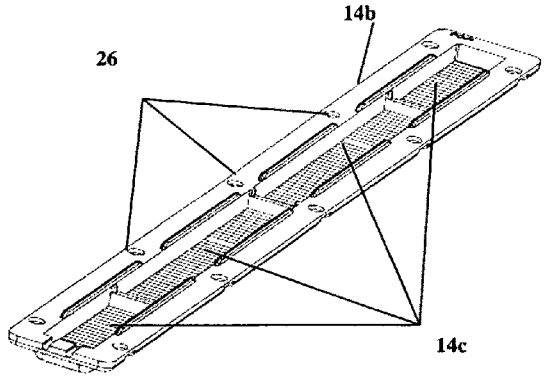
FIG. 7D is a perspective rear view of the outer lens of FIG. 6.

In a preferred embodiment the lenslets 14*a* may be grouped together in pairs as illustrated in FIGS. 6A-6C in each light engine 200. Each pair of lenslets 14*a* is provided on a carrier 24 that has a barbell shape. The center of the carrier 24 may be used as an attachment point to the lamp 10. FIGS. 7A-7D illustrate a preferred embodiment of the outer lens 14*b* for use with the lenslets 14*a* in each of the light engines. The outer lens 14*b* is preferably formed as a single unit and includes the plurality of facets 14*c* formed on an inner surface thereof. The facets 14*c* in the middle, top and bottom of the outer lens 14*b* may have different angles, if desired, but all have a similar general shape. Specifically, in each light engine, the two middle LEDs 12 preferably have facets 14*c* with an angle of approximately 25 degrees while the upper two LEDs 12 would have facets with an angle of 10 degrees and the lower two LEDs would have an angle of 40 degrees. The outer periphery of the outer lens 14*b* preferably includes several openings 26 that may be used to accommodate fasteners, such as screws, for example, to attach the outer lens 14*b* to the lamp housing 10*a*. In another embodiment, the outer lens 14*b* has a substantially flat inner surface and simply continues to direct light in the first direction of the lenslet 14*a*.

Figure 8:
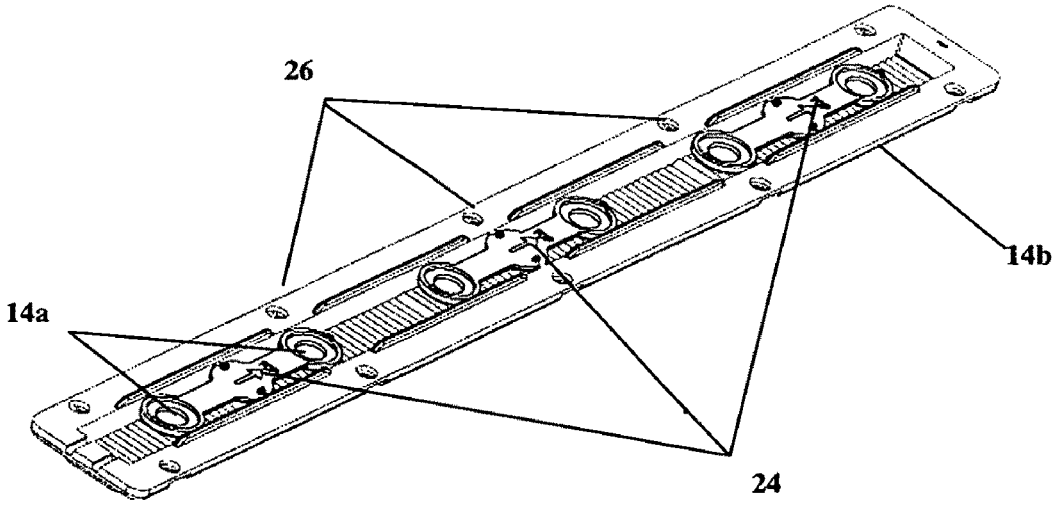
FIG. 8 is an illustration of how several carriers such as that illustrated in FIGS. 6A-6C are mounted in the outer lens of FIGS. 7A-7D.

FIG. 8 illustrates the carriers 24 mounted in the outer lens 14*b* in a single light engine 200. As illustrated, the lenslets 14*a* are positioned with facets 14*c* positioned in front of them. The arrows on the carriers 24 include an indication of which end of the outer lens 14*b* is the top.

As noted above, the lamp 10 of the present application preferably utilizes 4 light engines 200, with each light engine including 6 LEDs 12 with 6 corresponding lenslets 14*a*. Additional, or fewer, light engines 200 may be included in the lamp 10, if desired. LEDs use substantially less power than incandescent bulbs, and also generally have a much longer life in service. Typically, an LED will last about 12 times longer that an incandescent bulb. Thus, the lamp 10 of the present application will save time and expense in maintenance and will also save substantial energy. As is noted above, the lamp 10 of the present disclosure utilizes about 90 Watts of power as compared to the 300 W used by conventional lamps using incandescent bulbs. At the same time the LEDs 12 and lens assembly 14 provide sufficient light to allow workers to work as efficiently and as safely as a conventional lamp bank. Indeed, the light engines of the lamp 10 of the present application provide a very high output of light, generally more than 1500 lumens. The LEDs are preferably high output LEDs like the Philips Lumiled Luxeon Rebel, for example. Any suitable high output LED may be used, however.

Although the present invention has been described in relation to particular embodiments thereof, many other variations and modifications and other uses will become apparent to those skilled in the art.

What is claimed is:

1. A portable lamp operable supplied by an external high voltage input voltage comprising:

an elongated housing;

a power source electrically connected to the external high voltage input voltage to provide a substantially constant driving voltage; and a first light engine mounted in the elongated housing and electrically connected to the power source, the light engine further comprising:

a plurality of high output light emitting diodes that are driven based on the driving voltage of the power source to provide output light.

2. The portable lamp of claim 1, wherein the power source further comprises a rectifier circuit electrically connected to the high voltage input voltage to provide polarity independence in the power source.

3. The portable lamp of claim 2, further comprising a lens assembly, the light assembly including:

a plurality of lenslets, wherein a single lenslet is positioned over each high output light emitting diode of the plurality of high output light emitting diodes and is operable to reduce an emission angle of light collected from each high output light emitting diode; and an outer lens, spaced away from the plurality of lenlets, wherein the outer lens is a prismatic lens operable to deflect and angularly shift a center of light beams from the lenslet.

4. The portable lamp of claim 3, wherein the outer lens further comprises a plurality of facets formed on an interior surface thereof to deflect light.

5. The portable lamp of claim 4, wherein the first light engine further comprises:

a printed circuit board operable for receiving the plurality of high output light emitting diodes and electrically connected to the power source to drive the plurality of high output light emitting diodes;

a heat sink thermally coupled to the printed circuit board to draw heat away from the high output light emitting diodes.

6. The portable lamp of claim 5, wherein the light engine further comprises a current control circuit electrically connected to the power source to receive the drive voltage and to provide a driving current to the plurality of high output light emitting diodes based on the driving voltage.

7. The portable lamp of claim 6, further comprising a gasket positioned between the outer lens and the heat sink to prevent moisture from entering the engine.

8. The portable lamp of claim 3, further comprising:

a first resilient bumper positioned at a first end of the elongated housing; and a second resilient bumper positioned at a second end of the elongated housing, opposite the first end.

9. The portable lamp of claim 3, wherein the elongated housing is made of low smoke zero halogen plastic.

10. The portable lamp of claim 3, further comprising a power cable electrically connected to the power source to provide the external high voltage input voltage.

11. The portable lamp of claim 10, further comprising a bracket positioned on a rear of the elongated housing and operable to receive and store the power cable.

12. The portable lamp of claim 11, wherein the light engine further comprises a carrier, the carrier including two lenslets positioned at opposite ends of the carrier.

13. The portable lamp of claim 12, wherein the outer lens is formed as a single integrated piece and wherein the at least one carrier is operable for mounting in the outer lens such that the two lenslets of the at least one carrier cover two high output light emitting diodes.

14. The portable lamp of claim 13, wherein the light engine includes 6 high output light emitting diodes.

15. The portable lamp of claim 14, wherein each lenslet is made of a polycarbonate material.

16. The portable lamp of claim 15, wherein each lenslet has a thickness of 2.8 mm and a diameter of 10.0 mm.

17. The portable lamp of claim 3, wherein the external high voltage input voltage exceeds 277V.

18. The portable lamp of claim 3, wherein the plurality of high output light emitting diodes output light in excess of 1500 lumens.

19. A lens assembly for use in a portable lamp including a plurality of high output light emitting diodes, the lens assembly comprising:

a plurality of lenslets, wherein a single lenslet is positioned in front of each high output light emitting diode of the plurality of high output light emitting diodes, the single lenslet operable to reduce an emission angle of light collected from each high output light emitting diode; and an outer lens, removably mounted in front of the plurality of lenslets and operable to deflect and angularly shift a center of light beams from the lenslet.

20. The lens assembly of claim 19, wherein the outer lens includes a plurality of facets formed on an inner surface thereof to direct light.

21. The lens assembly of claim 19, wherein the outer lens does not deflect light.

22. A light engine for use in a portable lamp including a power source providing a driving voltage and supplied by an external high voltage input voltage comprising:

a plurality of high output light emitting diodes;

a printed circuit board operable to electrically connect the power source to the plurality of light emitting diodes;

a control circuit operable to control a driving current provided to the plurality of light emitting diodes based on the driving voltage provided by the power source; and an electromagnetic interference filter electrically connected with the power source and configured to minimize electromagnetic interference.

23. The light engine of claim 22, wherein the control circuit is integral with the printed circuit board.

24. The light engine of claim 23, wherein the control circuit is integral with the power source and separated from the printed circuit board.

* * * * *